US012037782B2

(12) United States Patent
Ellenberger

(10) Patent No.: US 12,037,782 B2
(45) Date of Patent: Jul. 16, 2024

(54) HINGED HEELED CONNECTOR FOR TRUSSES FOR MANUFACTURED HOUSING

(71) Applicant: Simpson Strong-Tie Company Inc., Pleasanton, CA (US)

(72) Inventor: Brian Ellenberger, Butler, PA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

(21) Appl. No.: 17/683,129

(22) Filed: Feb. 28, 2022

(65) Prior Publication Data

US 2023/0272613 A1 Aug. 31, 2023

(51) Int. Cl.

| | |
|---|---|
| ***E04B 1/344*** | (2006.01) |
| ***E04B 1/38*** | (2006.01) |
| ***E04C 3/17*** | (2006.01) |

(52) U.S. Cl.

CPC ..... *E04B 1/3445* (2013.01); *E04B 1/388* (2023.08); *E04C 3/17* (2013.01); *E04B 2001/389* (2023.08)

(58) Field of Classification Search

CPC .... E04B 1/3445; E04B 1/40; E04B 2001/405; E04B 1/388; E04B 2001/389; E04B 2001/2616; E04B 1/2608; E04C 3/17

See application file for complete search history.

(56) References Cited

U.S. PATENT DOCUMENTS

| | | | | |
|---|---|---|---|---|
| 506,006 | A | 10/1893 | Kreider | |
| 1,551,716 | A | 9/1925 | Van Der Kloet et al. | |
| 1,787,167 | A * | 12/1930 | Purdy | E04B 1/2604 16/249 |
| 3,337,946 | A | 8/1967 | Anderson et al. | |

(Continued)

FOREIGN PATENT DOCUMENTS

| | | |
|---|---|---|
| DE | 10 2006 038 054 A1 | 2/2008 |
| EP | 0 357 273 | 3/1990 |

(Continued)

OTHER PUBLICATIONS

European Patent Office, The International Search Report and The Written Opinion of the International Searching Authority, or the Declaration: PCT/US2023/013962, dated Jun. 23, 2023, 10 pages, International Searching Authority, European Patent Office, Netherlands.

(Continued)

*Primary Examiner* — Rodney Mintz
(74) *Attorney, Agent, or Firm* — Charles R. Cypher

(57) ABSTRACT

A connector and a method of providing a framing component for building construction are disclosed, the connector including a first member having opposite plate members with a top portion and a bottom portion, wherein the top portion is pivotally connected to the bottom portion, and a second member having a base member with attachment members, wherein the second member is attached at an angle of 14-50 degrees to the first member. The method is a method of providing a framing component for building construction, the method including the steps of providing the connector, connecting a top chord to the top portion of the connector, and connecting a bottom chord of a wooden joist to the bottom portion of the connector, wherein the connector connects the top chord and the bottom chord in such a way to allow for the top chord and bottom chord to stay in intact.

19 Claims, 5 Drawing Sheets

(56) References Cited

U.S. PATENT DOCUMENTS

| | | | | |
|---|---|---|---|---|
| 3,535,845 | A | 10/1970 | Troutner | |
| 3,605,355 | A | 9/1971 | Solesbee | |
| 3,646,725 | A * | 3/1972 | Troutner | E04C 3/17 52/693 |
| 3,785,108 | A | 1/1974 | Satchell et al. | |
| 4,167,090 | A | 9/1979 | Sanford | |
| 4,261,155 | A * | 4/1981 | Gilb | E04B 1/2612 248/282.1 |
| RE31,234 | E | 5/1983 | Jureit et al. | |
| 4,381,635 | A * | 5/1983 | Solo | E04C 3/17 52/639 |
| 4,513,474 | A | 4/1985 | Watabe | |
| 4,744,192 | A | 5/1988 | Commins | |
| 4,831,807 | A | 5/1989 | Bolt | |
| 4,872,297 | A | 10/1989 | Hetzel et al. | |
| 5,094,059 | A | 3/1992 | Ganescu | |
| 5,119,966 | A | 6/1992 | McKim et al. | |
| 5,230,198 | A * | 7/1993 | Callies | E04B 7/045 52/696 |
| 5,307,603 | A | 5/1994 | Chiodo | |
| 5,426,822 | A | 6/1995 | Weir | |
| D364,794 | S | 12/1995 | Eberschlag | |
| 5,553,961 | A | 9/1996 | Olden | |
| 5,660,012 | A | 8/1997 | Knudson | |
| 5,720,571 | A | 2/1998 | Frobosilo et al. | |
| 5,722,210 | A | 3/1998 | Baker et al. | |
| 5,788,204 | A * | 8/1998 | Goodwin | E04G 5/02 248/237 |
| 5,819,492 | A | 10/1998 | Konicek | |
| 5,839,848 | A | 11/1998 | Sahramaa | |
| 5,857,295 | A * | 1/1999 | Mikawa | E04B 7/045 52/712 |
| 5,890,339 | A | 4/1999 | Willis | |
| 6,401,422 | B1 | 6/2002 | Olden | |
| 6,430,887 | B1 | 8/2002 | Daudet | |
| 6,662,517 | B1 | 12/2003 | Thompson | |
| 7,131,243 | B1 | 11/2006 | Sirowatka | |
| 7,200,972 | B1 | 4/2007 | Freeman et al. | |
| 7,707,785 | B2 | 5/2010 | Lin | |
| 7,716,877 | B2 | 5/2010 | Gilstrap et al. | |
| 7,798,461 | B2 * | 9/2010 | Hackney | E04B 7/045 248/397 |
| 7,891,144 | B2 * | 2/2011 | Gilstrap | E04B 7/045 52/712 |
| 8,056,932 | B2 | 11/2011 | Wents | |
| 8,245,479 | B2 | 8/2012 | Gannon et al. | |
| 8,453,403 | B2 | 6/2013 | Wheeler | |
| 8,555,580 | B2 | 10/2013 | Vilasineekul | |
| 9,045,895 | B1 | 6/2015 | Lin | |
| 9,175,472 | B1 * | 11/2015 | Calini | E04B 1/40 |
| 9,347,231 | B2 * | 5/2016 | Cormier | E04B 1/4157 |
| 10,202,766 | B1 | 2/2019 | Fox | |
| 10,465,389 | B2 * | 11/2019 | Hughes | E04F 10/08 |
| 10,626,601 | B2 * | 4/2020 | Gosling | E04B 2/7438 |
| 11,041,303 | B2 * | 6/2021 | Marlow | E04B 1/2604 |
| 11,118,727 | B2 * | 9/2021 | McKechnie | E04B 9/183 |
| 11,131,088 | B2 | 9/2021 | Benton et al. | |
| 11,149,431 | B1 * | 10/2021 | Meznarich | E04B 1/40 |
| 2003/0154685 | A1 | 8/2003 | Williams | |
| 2004/0103597 | A1 * | 6/2004 | Ellenberger | E04B 7/24 52/90.2 |
| 2006/0185311 | A1 | 8/2006 | Attalla et al. | |
| 2007/0292204 | A1 * | 12/2007 | Hackney | E04B 1/10 403/93 |
| 2008/0277551 | A1 * | 11/2008 | Hackney | E04B 1/2604 248/276.1 |
| 2013/0062491 | A1 * | 3/2013 | Cormier | E04B 1/4157 248/304 |
| 2014/0212203 | A1 | 7/2014 | Kochanawski | |
| 2018/0334801 | A1 * | 11/2018 | Brean | E04B 7/163 |
| 2019/0003178 | A1 * | 1/2019 | Gosling | E04B 2/7425 |
| 2019/0093366 | A1 * | 3/2019 | Hughes | E04B 1/003 |
| 2019/0234064 | A1 * | 8/2019 | Benton | E04B 1/58 |
| 2019/0285224 | A1 * | 9/2019 | McKechnie | E04B 9/20 |
| 2020/0224688 | A1 * | 7/2020 | Evans | F16B 9/052 |
| 2020/0291643 | A1 * | 9/2020 | Marlow | E04B 1/2604 |
| 2021/0310237 | A1 | 10/2021 | Marlow | |

FOREIGN PATENT DOCUMENTS

| | | |
|---|---|---|
| EP | 2 378 018 A2 | 10/2011 |
| FR | 2 981 865 | 5/2013 |
| GB | 539356 | 9/1941 |
| GB | 1 362 019 | 7/1974 |

OTHER PUBLICATIONS

Simpson Strong-Tie Company Inc., Connectors for Wood Construction, Jan. 1, 1992, cover page, p. 33, back page, Catalog C-92H-1, Simpson Strong-Tie Company, Inc., Pleasanton, CA, United States.

Simpson Strong-Tie Company Inc., Wood Construction Connectors 2009-2010, Jan. 1, 2009, cover page, p. 147, back page, Catalog C-2009, Simpson Strong-Tie Company, Inc., Pleasanton, CA, United States.

Simpson Strong-Tie Company Inc., Wood Construction Connectors 2017-2018, Jan. 1, 2017, cover page, p. 142, back page, Catalog C-C-2017, Simpson Strong-Tie Company, Inc., Pleasanton, CA, United States.

* cited by examiner

HINGED HEELED CONNECTOR FOR TRUSSES FOR MANUFACTURED HOUSING

BACKGROUND OF THE INVENTION

1. Field of Invention

This invention relates to the building and transportation of modular homes and more particularly to hinge connectors for the breakdown and transportation of trusses.

2. Description of Related Art

A hinge connector is a component that attaches to a truss used to build a modular home. The purpose of the hinge connector is to connect a solid sawn top chord to an engineered wood truss bottom chord. Hinge connectors are primarily used within the manufactured housing industry. They are used to transport a house module or modular home in the easiest and most efficient way possible.

In the transportation and shipping of trusses, a truss must be within the legal height and width limits in order to be transported via a road, interstate, or highway. A truss is typically manufactured at a plant, then shipped or transported to the location where it will be installed. Since a truss is too large to transport down the highway, it must be broken down for transport.

The major problem with current hinge connectors used is that the cords of the truss have to be broken down for transport. Typically, a cord is split down the middle in order to break the truss down to prepare it for transport. Additionally, current hinge connectors simply provide a hinge. They do not provide any additional support for the truss.

Prior attempts have been made to connect trusses using a hinge connector. U.S. Pat. No. 6,401,422 describes a connector for interconnection of disconnected truss members. The connector comprises an elongated sheet metal plate including a first plate portion and a second plate portion. The first plate portion has nailing teeth adapted to be driven into a truss member for permanently attaching the first plate portion to one member. The second plate portion has nail holes formed in it for receiving nails to permanently attach the second plate portion to another of the truss members. The second truss plate portion is substantially free of nailing teeth at the peripheries of the nail holes, but has at least one nailing tooth for temporary connection of the second plate portion to the truss during transport. The truss can be collapsed and transported to the building site with the truss members disconnected. The truss can then be erected and the truss members connected by positioning the second plate over a face ofthe other truss member and securing the second plate to the other truss member by driving nails through the holes.

U.S. Pat. No. 11,131,088 describes a hinged connector used to attach two generally coplanar first and second structural members while allowing for pivotal movement of the structural members in the plane of the structural members about an axis that is transverse or perpendicular to the plane in which the structural members rotate.

US Application No. 2021/0310237 describes a structural support apparatus, system, and installation method, comprising a base member adapted for being mounted to an existing building structure, an attachment bracket mounted to the base member at a pivot point adapted to be set securely to an angle selected during installation, the attachment bracket also adapted for mounting to a wood riser having openings therein to match the attachment bracket.

Despite the foregoing developments, there is still a need for systems and methods to easily collapse a truss without having to break the cords of the truss.

All references cited herein are incorporated herein by reference in their entireties.

BRIEF SUMMARY OF THE INVENTION

Accordingly, a first aspect of the invention is a connector for attaching building framing components together comprising a first member having opposite plate members each of which comprises a top portion pivotally connected to a bottom portion, and a second member having a base member with attachment members, wherein the second member is attached at an angle of 14 degrees to 50 degrees to the first member and the first member and the second member include holes configured to receive fasteners for fastening the connector to the building framing components.

In certain embodiments, the top portion and the bottom portion of the opposite plate members are brackets.

In certain embodiments, the top portion of the opposite plate members is pivotally connected to the bottom portion by a hinge.

In certain embodiments, the bottom portion of the opposite plate members connects to the second member to form a U-shape.

In certain embodiments, the attachment members are opposite plate members perpendicularly connected to each side of the base member so as to form two separate upside down U-shapes on opposite ends of the base member.

A second aspect of the invention is a method for providing a framing component for building construction, the method including the steps of providing the connector, connecting a top chord to the top portion of the connector, and connecting a bottom chord of a wooden joist to the bottom portion of the connector, wherein the connector connects the top chord and the bottom chord in such a way to allow for the top chord and bottom chord to stay intact.

In certain embodiments, the top portion and the bottom portion of the opposite plate members are brackets.

In certain embodiments, the top portion of the opposite plate members is pivotally connected to the bottom portion by a hinge.

In certain embodiments, the bottom portion of the opposite plate members connects to the second member to form a U-shape.

In certain embodiments, the attachment members are opposite plate members perpendicularly connected to each side of the base member so as to form two separate upside down U-shapes on opposite ends of the base member.

In certain embodiments, the method further comprises the step of transporting the framing component from a manufacturing site to a building construction site with the top chord and the bottom intact.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF PREFERRED EMBODIMENTS OF THE INVENTION

A truss for a modular home must be broken down or collapsed in order to transport the house module or modular home within the legal limits of the roadways. The hinged heel connector connects a top chord rafter and the bottom chord of a wooden joist all while allowing the rafter to hinge at the location of the hinge connector.

The benefit of this invention is that the chords of the truss do not have to break like they would on a typical heel connector. Instead of splitting at the middle of the chord to break down the truss to transport, the inventive connector breaks down at the crux of the joist, leaving the top chord and bottom chord intact. In addition to this benefit, the inventive connector connects the top and bottom chord before shipment. Conventional connectors are generally connected to the top and bottom chord offsite (e.g., at a manufacturing site) and must be attached at the building site.

Figure 4:
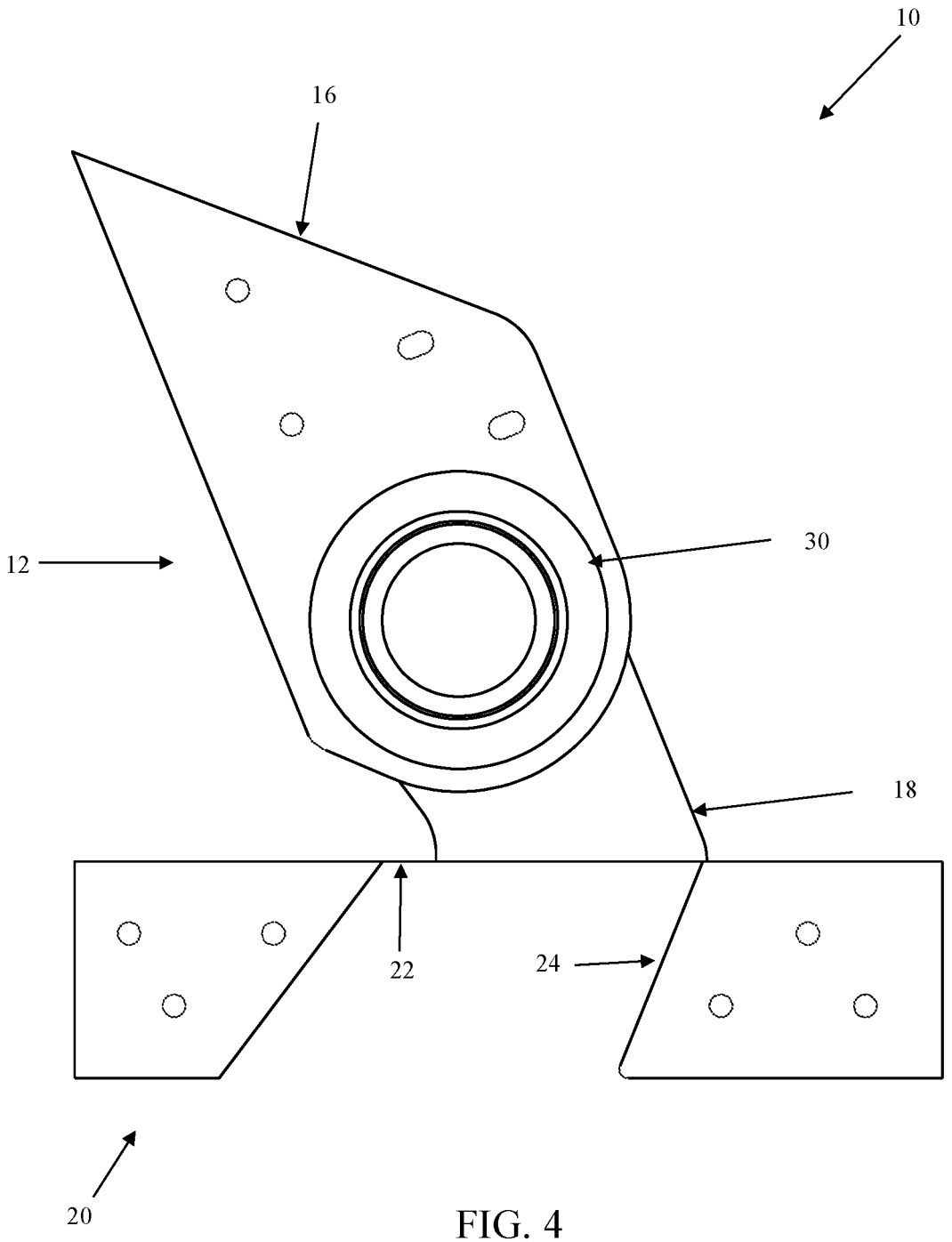
FIG. 4 is a side view of an embodiment of the connector including brackets and a circular hinge.

A first aspect of the invention includes a connector 10 for attaching components together comprising a first member 12 having opposite plate members 14 with a top portion 16 and a bottom portion 18 wherein the top portion 16 is pivotally connected to the bottom portion 18 and a second member 20 having a base member 22 with attachment members 24, wherein the second member 20 is attached at an angle of 14 degrees to 50 degrees to the first member 12, as shown in FIG. 4.

The angle at which the second member 20 is attached to the first member 12 is within a range of 14 degrees to 50 degrees, or more preferably from 20 degrees to 40 degrees.

Figure 1:
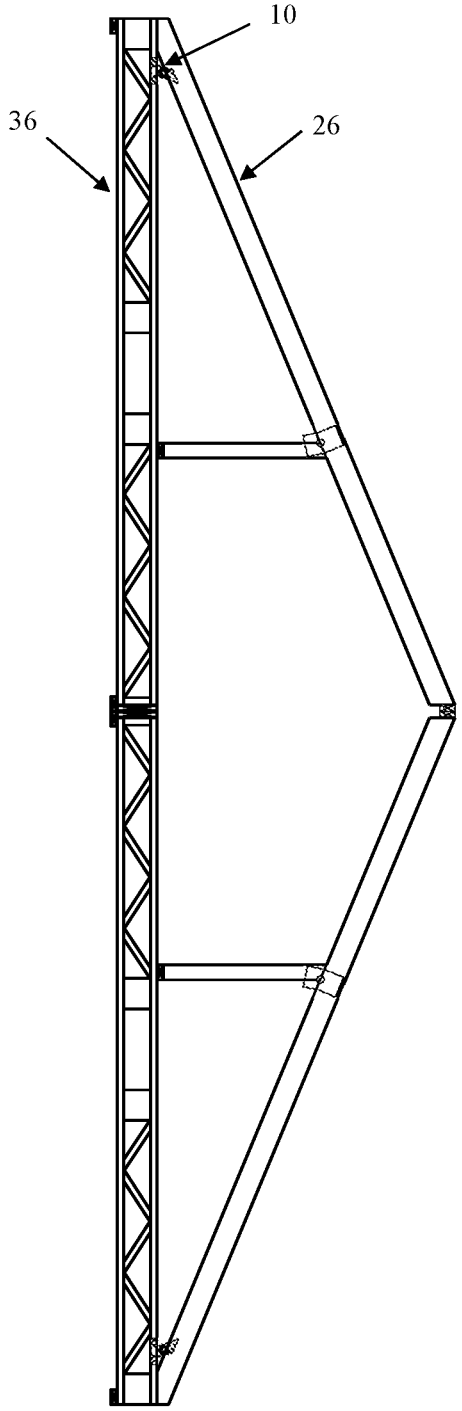
FIG. 1 is an side view of an embodiment of the connector connecting a top chord and a bottom chord of a truss.
Figure 2:
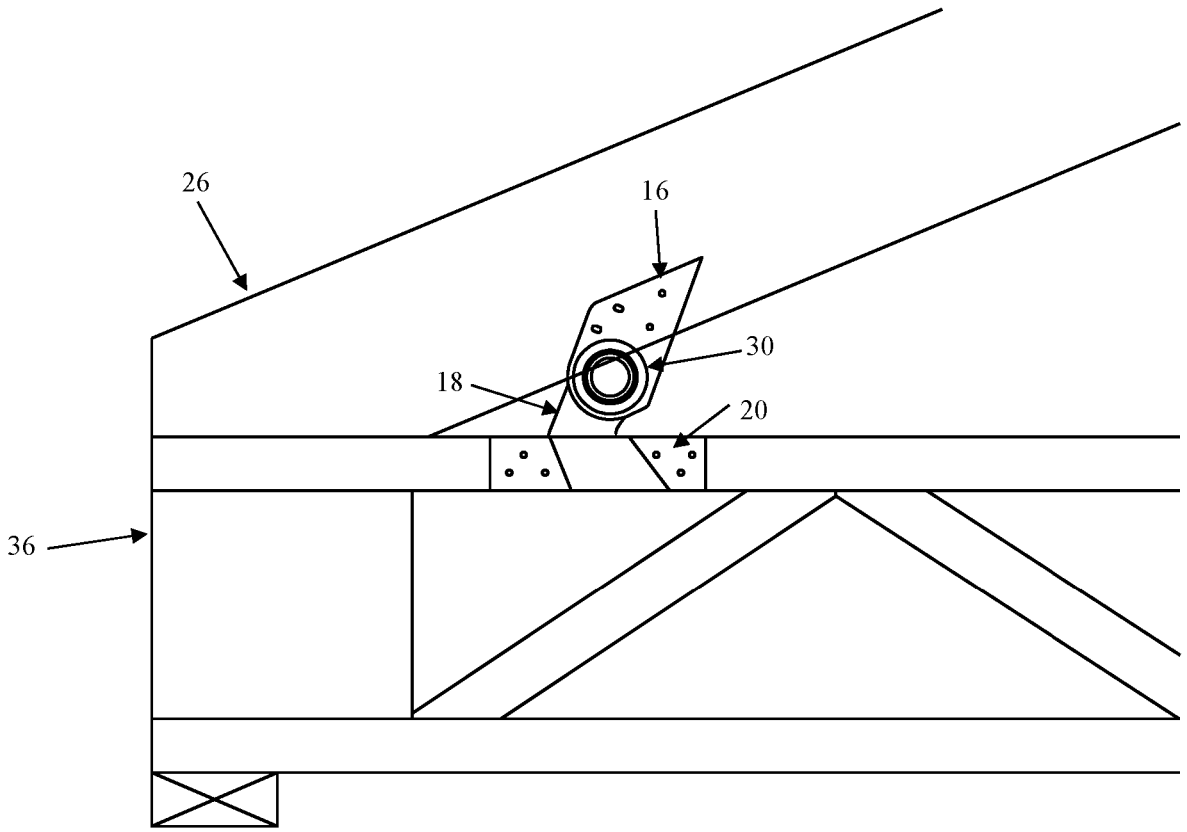
FIG. 2 is a side view of an embodiment of the connector including brackets and a circular hinge where the first member is attached to a top chord of a truss and the second member is attached to a bottom chord of a truss.

The first member 12 attaches to the top chord rafter 26 of a truss. The top chord rafter 26 is secured between the opposite plate members 14, as shown in FIG. 2.

In certain embodiments, the top portion 16 and the bottom portion 18 of the opposite plate members 14 are brackets 28. These brackets 28 are preferably identical opposing metal-plated brackets. The brackets are preferably made from materials such as steel with a zinc galvanized coating, but can be made from other suitable materials.

In certain embodiments, the top portion 16 of the opposite plate members 14 is pivotally connected to the bottom portion 18 by a hinge 30. The hinge 30 is preferably a circular hinge but can be other suitable alternative hinges. The hinges 30 on the brackets 28 allow the top chord rafter 26 to neatly fold down while still being secured to the bottom chord 36 of the wooden joist 32.

Figure 3:
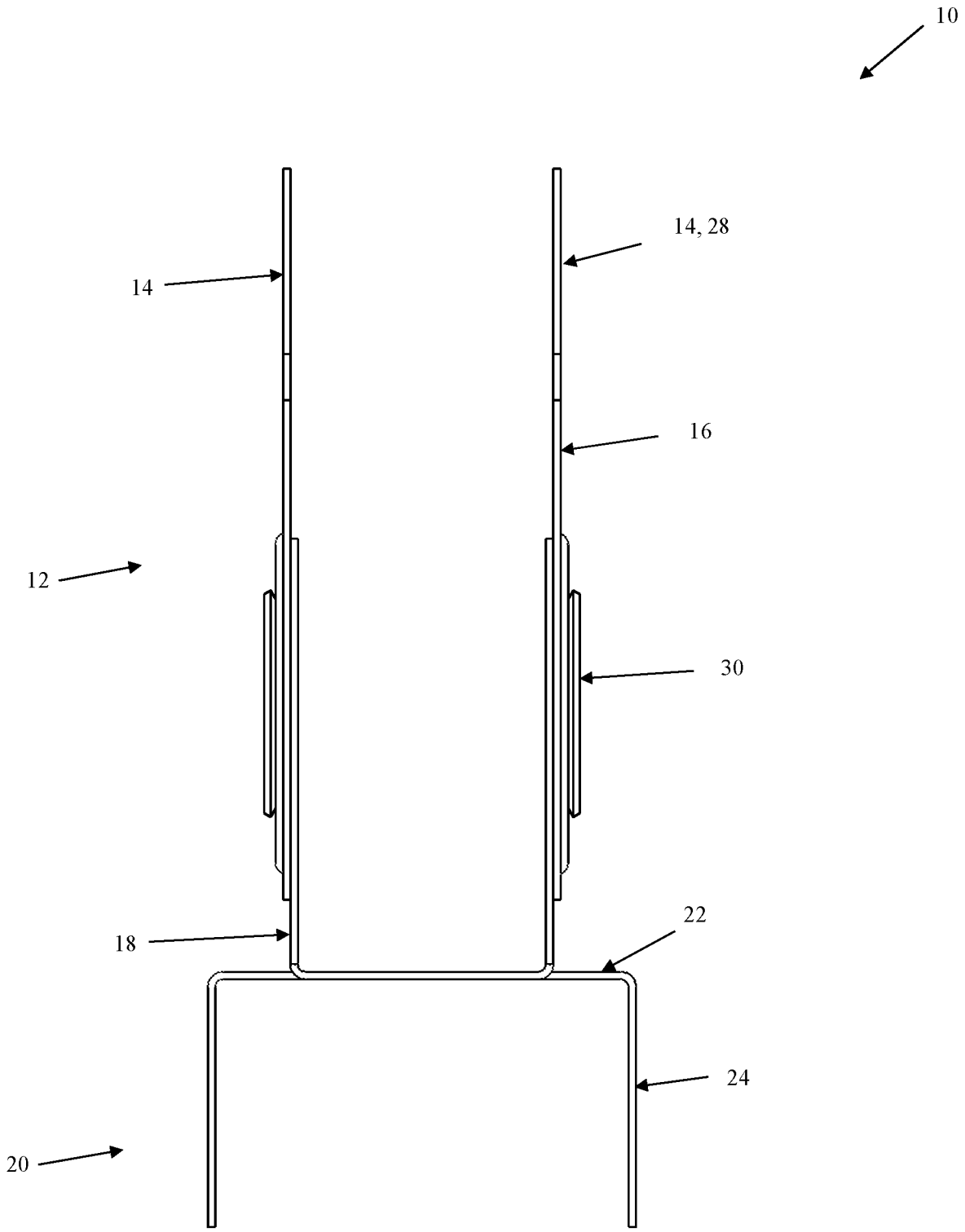
FIG. 3 is a front view of an embodiment of the connector where the first member includes mirrored brackets that form a U-shape and the second member form an upside down U-shape.

In certain embodiments, the bottom portion 18 of the opposite plate members 14 connects to the second member 20 to form a U-shape, as shown in FIG. 3.

In certain embodiments, the attachment members 24 on the second member 20 are opposite plate members 14 perpendicularly connected to each side of the base member 22 such to form upside down U-shapes on each side of the base member 22, as shown in FIGS. 3 and 4. The attachment members 24 are preferably identical opposing metal brackets that are connected at the top of the brackets to form an upside down U-shaped piece. The second member 20 attaches to the bottom chord 36 of a dimensional wood joist or an engineered wood joist and is secured in the U-shaped center of the second member 20, as shown in FIG. 2.

Figure 5:
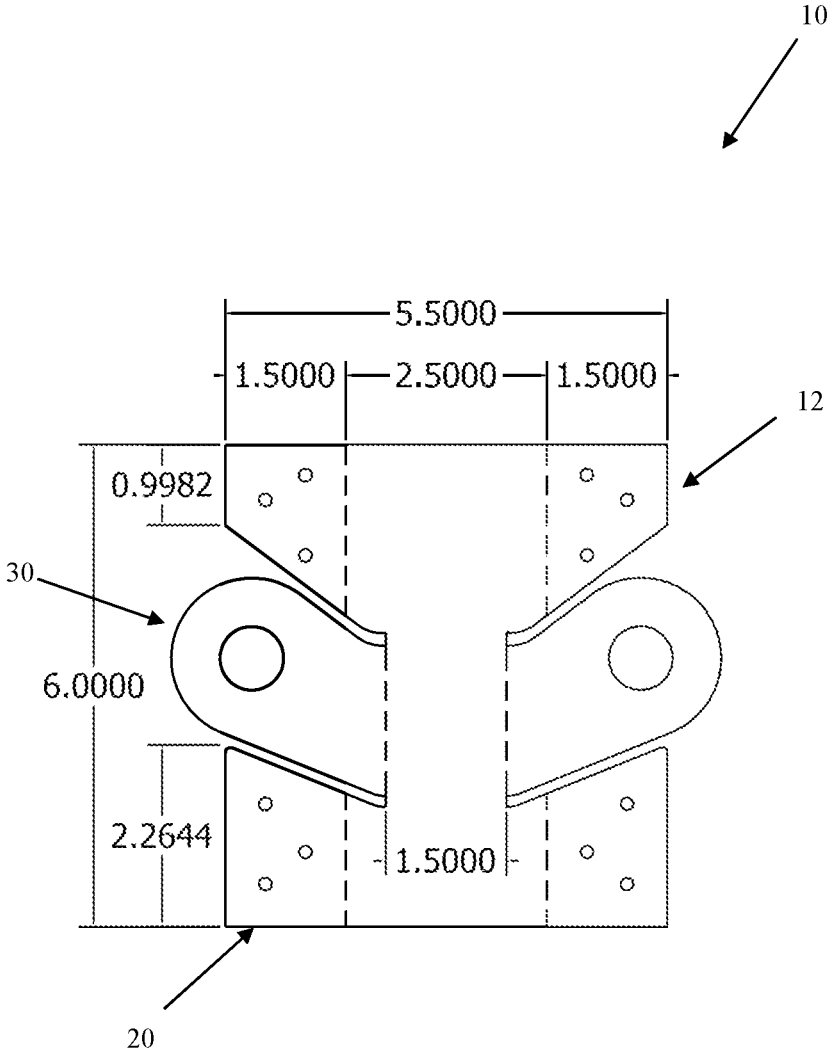
FIG. 5 is an overhead view of a workpiece from which an embodiment of the connector can be manufactured.

The connector 10 is manufactured by using a die-punch or other tools producing the same or similar result. A workpiece from which an embodiment of the connector 10 can be manufactured is shown in FIG. 5.

The connector 10 also serves the additional purpose of providing extra support at the crux of the joist 34 because of the way the connector 10 saddles the bottom chord 36 of the wooden joist 32.

A second aspect of the invention includes a method of providing a framing component for building construction which includes the steps of providing the connector 10, connecting a top chord rafter 26 to the top portion 16 of the connector 10, and connecting a bottom chord 36 of a wooden joist 32 to the bottom portion 18 of the connector 10. The connector 10 connects the top chord rafter 26 and the bottom chord 36 in such a way to allow for the top chord rafter 26 and the bottom chord 36 to stay intact, in particular during transport.

In certain embodiments, the method includes the step of transporting the framing component from a manufacturing site to a building construction site with the top chord and the bottom intact. This method of transportation prevents the chords of the truss from breaking as typically seen with known hinged connectors in the art.

What is claimed is:

1. A connector for attaching building framing components together, the connector comprising:

a first member having first and second opposed plate members spaced apart from each other, the first plate member having a discrete first top portion pivotally connected by a discrete first hinge to a first bottom portion, the second plate member having a discrete second top portion pivotally connected by a discrete second hinge to a second bottom portion, the second hinge being independent of, separate from and spaced away from the first hinge such that the first top portion and the second top portion pivot independently of one another; and a second member having a base member with one or more attachment members connected thereto, with the first and second bottom portions of the first member being fixedly attached to the base member of the second member and extending upwardly therefrom.

2. The connector of claim 1, wherein:

the base member of the second member is a substantially planar member and the first and second bottom portions of the first and second opposed plate members of the first member extend upwardly therefrom at an angle of 14-50 degrees.

3. The connector of claim 1, wherein in each of the one or more attachment members of the second member there is a pair of opposed and separated plate members connected to opposed sides of the base member and extending away from the first member, and where there is more than one of the one or more attachment members there is space between the one or more attachment members along the base member of the second member.

4. The connector of claim 3, wherein:

the opposed and separated plate members of the one or more attachment members of the second member are substantially planar members and the first and second top portions of the first and second opposed plate members of the first member are substantially planar; and the opposed and separated plate members of the one or more attachment members of the second member are disposed in parallel relation to the first and second top portions of the first and second opposed plate members of the first member.

5. The connector of claim 4, wherein:

the opposed and separated plate members of the one or more attachment members of the second member are spaced apart from each other a first selected distance, and the first and second top portions of the first and second opposed plate members of the first member are spaced apart from each other a second selected distance that is different from the first selected distance.

6. The connector of claim 5, wherein:

the base member of the second member is a substantially planar member and the first and second bottom portions of the first and second opposed plate members of the first member extend upwardly therefrom at an angle of 14-50 degrees.

7. The connector of claim 1, wherein:

a rafter is attached to the first and second top portions of the connector; and a joist is attached to the second member of the connector.

8. The connector of claim 7, wherein:

separate fasteners are driven through the first and second top portions of the first and second plate members of the first member and into the rafter to attach the rafter to the first member; and separate fasteners are driven through the one or more attachment members of the second member to and into the joist to attach the joist to the second member.

9. The connector of claim 7, wherein:

the base member of the second member interfaces with the joist.

10. The connector of claim 7, wherein:

the base member of the second member is a substantially planar member and the first and second bottom portions of the first and second opposed plate members of the first member extend upwardly therefrom at an angle of 14-50 degrees.

11. The connector of 16, wherein:

only the top portions of the first and second opposed plate members of the connector interface with the rafter, with the remaining portions of the connector not being in contact with the rafter.

12. The connector of claim 11, wherein:

the base member of the second member interfaces with the joist.

13. The connector of claim 7, wherein:

in each of the one or more attachment members of the second member there is a pair of opposed and separated plate members connected to opposed sides of the base member and extending away from the first member, and where there is more than one of the one or more attachment members there is space between the one or more attachment members along the base member of the second member.

14. The connector of claim 13, wherein:

the opposed and separated plate members of the one or more attachment members of the second member are substantially planar members and the first and second top portions of the first and second opposed plate members of the first member are substantially planar; and the opposed and separated plate members of the one or more attachment members of the second member are disposed in parallel relation to the first and second top portions of the first and second opposed plate members of the first member.

15. The connector of claim 14, wherein:

the opposed and separated plate members of the one or more attachment members of the second member are spaced apart from each other a first selected distance, and the first and second top portions of the first and second opposed plate members of the first member are spaced apart from each other a second selected distance that is different from the first selected distance.

16. The connector of 19, wherein:

only the top portions of the first and second opposed plate members of the connector interface with the rafter, with the remaining portions of the connector not being in contact with the rafter.

17. The connector of claim 16, wherein:

the base member of the second member is a substantially planar member and the first and second bottom portions of the first and second opposed plate members of the first member extend upwardly therefrom at an angle of 14-50 degrees.

18. A method of providing a framing component for building construction, said method comprising:

providing the connector of claim 1;

connecting a rafter to the first and second top portions of the connector; and connecting a joist to the second member of the connector.

19. The method of claim 18, wherein in each of the one or more attachment members of the second member there is a pair of opposed and separated plate members connected to opposed sides of the base member and extending away from the first member, and where there is more than one of the one or more attachment members there is space between the one or more attachment members along the base member of the second member.

* * * * *